US007571668B1

(12) United States Patent
Chang

(10) Patent No.: US 7,571,668 B1
(45) Date of Patent: Aug. 11, 2009

(54) WOUNDABLE RATCHET WRENCH

(76) Inventor: Ji-Jong Chang, No. 37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 12/115,549

(22) Filed: May 6, 2008

(51) Int. Cl.
*B25B 17/00* (2006.01)
*B25B 13/46* (2006.01)

(52) U.S. Cl. ..... 81/57.29; 81/58.1; 81/63.2

(58) Field of Classification Search ..... 81/57.29, 81/64, 57.13, 177.6, 60–63.2
See application file for complete search history.

(56) References Cited

U.S. PATENT DOCUMENTS 2,796,101 A * 6/1957 Hasemann et al. ..... 81/64
2,814,322 A * 11/1957 Kupfrian ..... 81/64
4,362,072 A * 12/1982 Tillman ..... 81/57.29
5,584,220 A * 12/1996 Darrah et al. ..... 81/57.29
6,516,690 B2 * 2/2003 Chen ..... 81/63
6,732,614 B2 * 5/2004 Hu ..... 81/63.2
7,069,818 B1 * 7/2006 Huang ..... 81/57.29
7,267,033 B1 * 9/2007 Lai ..... 81/57.29

* cited by examiner

*Primary Examiner*—Hadi Shakeri

(57) ABSTRACT

The present invention discloses a woundable and unidirectional torque wrench which comprises a driving head, a first gearwheel, a second gearwheel, a woundable member, a resilient tube and a gripping member. The driving head includes a body, a rotating member, a pawl and a control structure. The first gearwheel is fixed to the rotating member. The second gearwheel is rotatably provided inside a pivot hole of the body and engages with the first gearwheel by teeth. One end of the woundable member can be driven by external force, and the other end is connected to the second gearwheel. The resilient tube accommodating the woundable member is connected to the body. The gripping member includes a bar member having two joint members provided at its two ends, and a third joint member couples with a connecting grip of the body.

10 Claims, 15 Drawing Sheets

WOUNDABLE RATCHET WRENCH

FIELD OF THE INVENTION

The present invention is related to a woundable ratchet wrench, especially related to a torque wrench with a woundable member, a resilient tube and a driving head so that the wrench can be wound at will to fit the work space and for operational convenience.

BACKGROUND OF THE INVENTION

A conventional wrench structure with a rotatable gripping member at the rear end of the wrench, such as U.S. Pat. No. 4,699,028 whose wrench structure is so designed that the end of the connecting grip of the wrench controls a 360° rotation. The pinion gear inside the connecting grip can be rotated. The pinion gear engages the gearwheel mounted in the rotating member. Thus, the gearwheel and the rotating member can jointly rotate. A raised coupling end is provided on the rotating member. The coupling end can couple a socket, and lock the coupling member by rotation.

The advantage of above mentioned prior art is when the wrench cannot be turned due to the limitation of the work space, the user can turn the pinion gear at the end of the connecting grip of the wrench so as to jointly drive the gearwheel and the rotating member. Thus, the space limitation can be solved. However, the connecting grip of the conventional wrench is with a fixed shape. If the work space is narrow and winding, it is difficult to use the wrench.

SUMMARY OF THE INVENTION

The major purpose of the present invention is to provide a wrench which coordinates with work environment. The wrench comprises one driving head, one first gearwheel, one second gearwheel, one woundable member, one resilient tube and one gripping member. Wherein, the driving head includes one body and one rotating member. The first gearwheel is fixed to a rotating member. Its outside is surrounded with a plurality of first tooth. The second gearwheel is provided inside the pivot hole. The second tooth member engaging the first tooth is provided at the frond end of the second gearwheel.

Wherein, the front end of the woundable member is fixedly connected to the rear end of the second gearwheel. The rear end can be driven by applying force. The resilient tube couples the woundable member. The front end of the resilient tube is fixedly connected to the body. The front end of the woundable member extends outside the resilient tube. Its gripping member includes one rigid straight bar member. The front end of the straight bar member connects the body. The rear end of the straight bar member has one fourth joint member which couples another end of the woundable member.

DETAILED DESCRIPTION OF EMBODIMENTS

Figure 1:
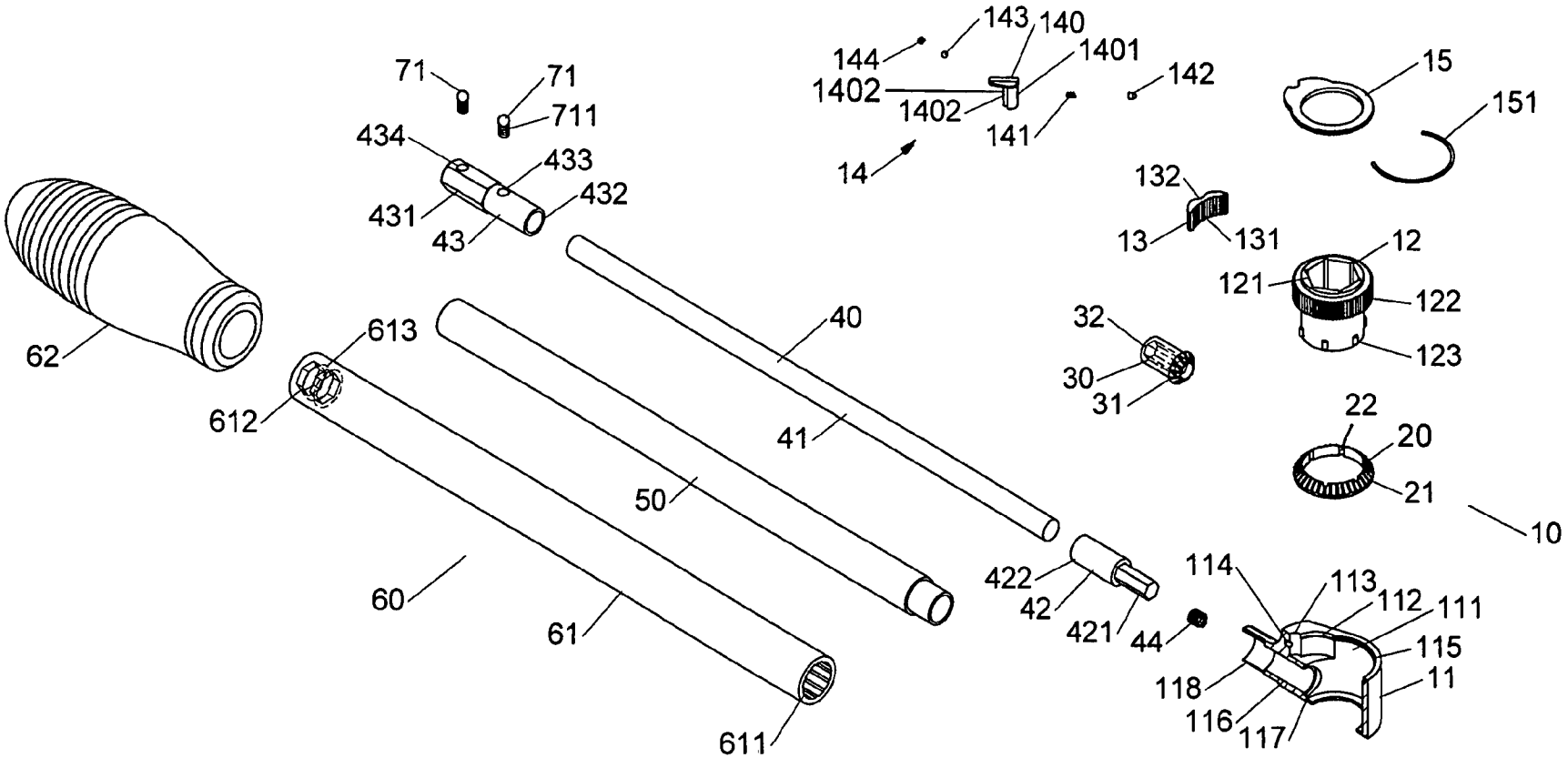
FIG. 1 is a 3D exploded view of one exemplary embodiment of the present invention.

Referring to FIG. 1, the present invention is a ratchet wrench, especially a woundable and can be controlled for one direction driving torque wrench. Its basic featuring structure comprises a driving head 10, a first gearwheel 20, a second gearwheel 30, a woundable member 40, a resilient tube 50 and a griping member 60. Wherein one embodiment of the driving head 10, which includes a body 11, a rotating member 12, a pawl 13, a control device 14, a cover member 15 and a snap ring 151. The body 11 has one first accommodation chamber 111 with a vertical facing opening. The first accommodation chamber 111 has a sunk wall which forms a second accommodation chamber 112 with smaller diameter communicating with the first accommodation chamber 111. The second accommodation chamber 112 has a sunk wall which forms a third accommodation chamber 113. The wall of the third accommodation chamber 113 defines a horizontally extended ball chamber 114 thereon. The inner surface of the top end of the first accommodation chamber 111 is surrounded with a snap ring chamber 115. One side of the body 11 stretches out to form a horizontal connecting grip 118. The connecting grip 118 has a small horizontally extended pivot hole 116. The juncture of the small pivot hole 116 and the first accommodation chamber 111 forms a bigger pivot hole 117 with a diameter bigger than the pivot hole 116.

The central axial line of the rotating member 12 vertically extends. A coupling member 121 is provided on the rotating member 12 for connecting a workpiece. The coupling member 121 can be a hex chamber. The outside top end of the rotating member 12 is surrounded with a plurality of meshing tooth 122. The outside bottom end of the rotating member 12 is surrounded with a plurality of outward raised first joint member 123. The rotating member 12 is mounted inside the first accommodation chamber 111 of the body 11, and is under the snap ring chamber 115.

The pawl 13 is in an arc shape, movably and rotatably mounted in the second accommodation chamber 112 and faces one front end of the rotating member 12. The front end is a big concavity. On the front end there is a plurality of retaining tooth 131 which engages the meshing tooth 122 of the rotating member 12. A small concavity 132 is provided at the rear end of the pawl 13. The pawl 13 is moveable inside the second accommodation 112 of the body 11. The control device 14 can control the contact position between the pawl 13 and the rotating member 12, and further control the rotating member 12 to make one direction clockwise turn or one direction counterclockwise turn. The control device 14 is in the third accommodation chamber 113 so as to drive the pawl 13 in the second accommodation chamber 112 of the body 11.

One exemplary embodiment of the control device 14 includes a control member 140, a resilient member 141, a support cap 142, a ball member 143 and one resilient unit 144. The control member 140 is rotatably mounted in the third accommodation chamber 113 of the body 11.

An accommodation hole 1401 is provided at one front end of the control member 140 facing the pawl 13. The accommodation hole 1401 is mounted with a resilient member 141 and a support cap 142. The support cap 142 shores up the small concavity 132 of the pawl 13 so that the retaining tooth 131 of the pawl 13 engages the meshing tooth 122 of the rotating member 12. One rear end of the control member 140 has two support sides 1402. The ball member 143 and the resilient unit 144 are inside the ball chamber 114 of the body 11. The ball member 143 under the pressure of the resilient unit 144 shores up one support side 1402 of the control member 140. Thus, the control member 140 is positioned in one angle.

The cover member 15 covers the first accommodation chamber 111, the second accommodation chamber and the third accommodation chamber 113 of body 11 so that the rotating member 12, the pawl 13 and the control member 140 are sealed inside. The cover member 15 is a thin ring.

The snap ring 151 is in a C-shape, and lodges in the snap ring chamber 115 of the body 11. The snap ring 151 fixes the cover member 15 on the body 11.

The outside of the first gearwheel 20 is surrounded with a plurality of first tooth 21. The plurality of first tooth 21 is formed a bevel gearwheel. The first gearwheel 20 is formed an annular ring shape. A second joint member 22 is provided on the inner surface of the first gearwheel 20 to coordinate with the first joint member 123 of the rotating member 12.

By means of the engagement between the first joint member 123 and the second joint member 22, the first gearwheel 20 is fixed to the rotating member 12. The first gearwheel 20 is still inside the first accommodation chamber 111 of body 11.

The second gearwheel 30 is rotatably mounted in the small pivot hole 116 of the body 11. The front end of the second gearwheel 30 facing to the rotating member 12 is provided with a plurality of second tooth 31. The plurality of second tooth 31 is formed a bevel gearwheel, inside the bigger pivot hole 117 of the body 11, and engages the first tooth 21 of the first gearwheel 20. The rear end opposite to the front end of the second gearwheel 30 has a coupling portion 32. The coupling portion 32 can be a hex chamber.

One front end of the woundable member 40 is fixedly connected to the second gearwheel 30. The rear end can be driven by external force. The woundable member 40 includes a woundable bar member 41, a front connector 42, a rear connector 43 and a first resilient unit 44. The woundable bar member 41 is a long extending soft bar body. The woundable bar member 41 can be bended or wound into several different shapes. The front end of the front connector 42 has a front coupling member 421. The front coupling member 421 couples the coupling portion 32 of the second gearwheel 30. The front coupling member 421 can be a hex column. The coupling portion 32 is a hex chamber to fit the hex column. The rear end of the front connector 42 has a rear coupling member 422 which couples the front end of woundable bar member 41. The front end of the rear connector 43 has a front coupling member 432 which is fixedly connected to the rear end of woundable bar member 41. The rear end of the rear connector 43 has a rear coupling member 431 which is a hex column, can couple a tool, and be driven by the tool. A first sunk hole 433 and a second sunk hole 434 are provided on outside surface of the rear connector 43.

The resilient unit 44 is inside the female coupling member 32 of the second gearwheel 30. The first resilient unit 44 shores up the area between the second gearwheel 30 and the front connector 42 of the woundable member 40. The resilient force of the first resilient unit 44 makes the second gearwheel 30 engage the first gearwheel 20.

The resilient tube 50 accommodates the woundable member 40. The front end of the resilient tube 50 is connected to the small pivot hole 116 of the body 11. The rear coupling member 431 of the rear connector 43 exposes outside the resilient tube 50. The resilient tube 50 can restore to original straight shape automatically if there is no external force to bend it. The resilient tube 50 can restrain the woundable member 40 to deform. The gripping member 60 includes one straight bar member 61 and one gripping unit 62. The straight bar member 61 is a rigid body which accommodates one resilient tube 50. The front end of the straight bar member 61 has one third joint member 611. The third joint member 611 couples the connecting grip 118 of the body 11. The rear end of the straight bar member 61 has one fourth joint member 612. The fourth joint member 612 couples the rear coupling member 431 of the rear connector 43. The fourth joint member 612 is a hex chamber whose inner surface has an annular positioning groove 613. The gripping unit 62 is connected to the straight bar member 61 for user's gripping purpose. When the third joint member 611 of the straight bar member 61 couples the connecting grip 118 of the body 11, the fourth joint member 612 doesn't couple the rear coupling member 431 of the rear connector 43. On the contrary if the third joint member 611 doesn't couple the connecting grip 118 of the body 11, the fourth joint member 612 will couple the rear coupling member 431 of the rear connector 43.

There are two second ball members 71 and two second resilient units 711. A second ball member 71 and a second resilient member 711 are accommodated in the first sunk hole 433 of the rear connector 43. Another second ball member 71 and another second resilient unit 711 are accommodated in the second sunk hole 434 of the rear connector 43. When the woundable member 40 and the straight bar member 61 make relatively motion, a second ball member 71 will lodge in the positioning groove 613 of the griping member 60.

Figure 2:
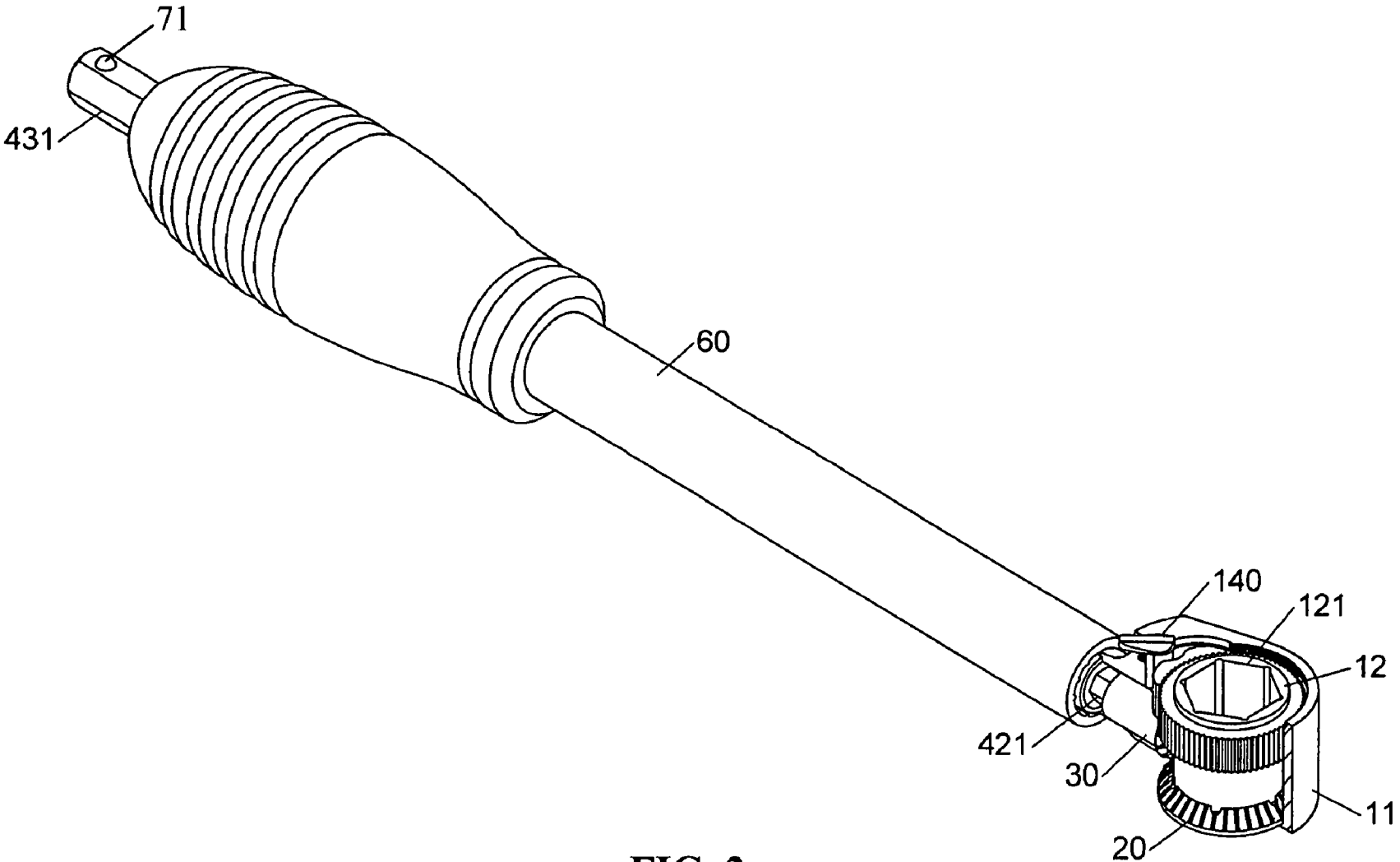
FIG. 2 is a partial sectional view of FIG. 1 being assembled.
Figure 3:
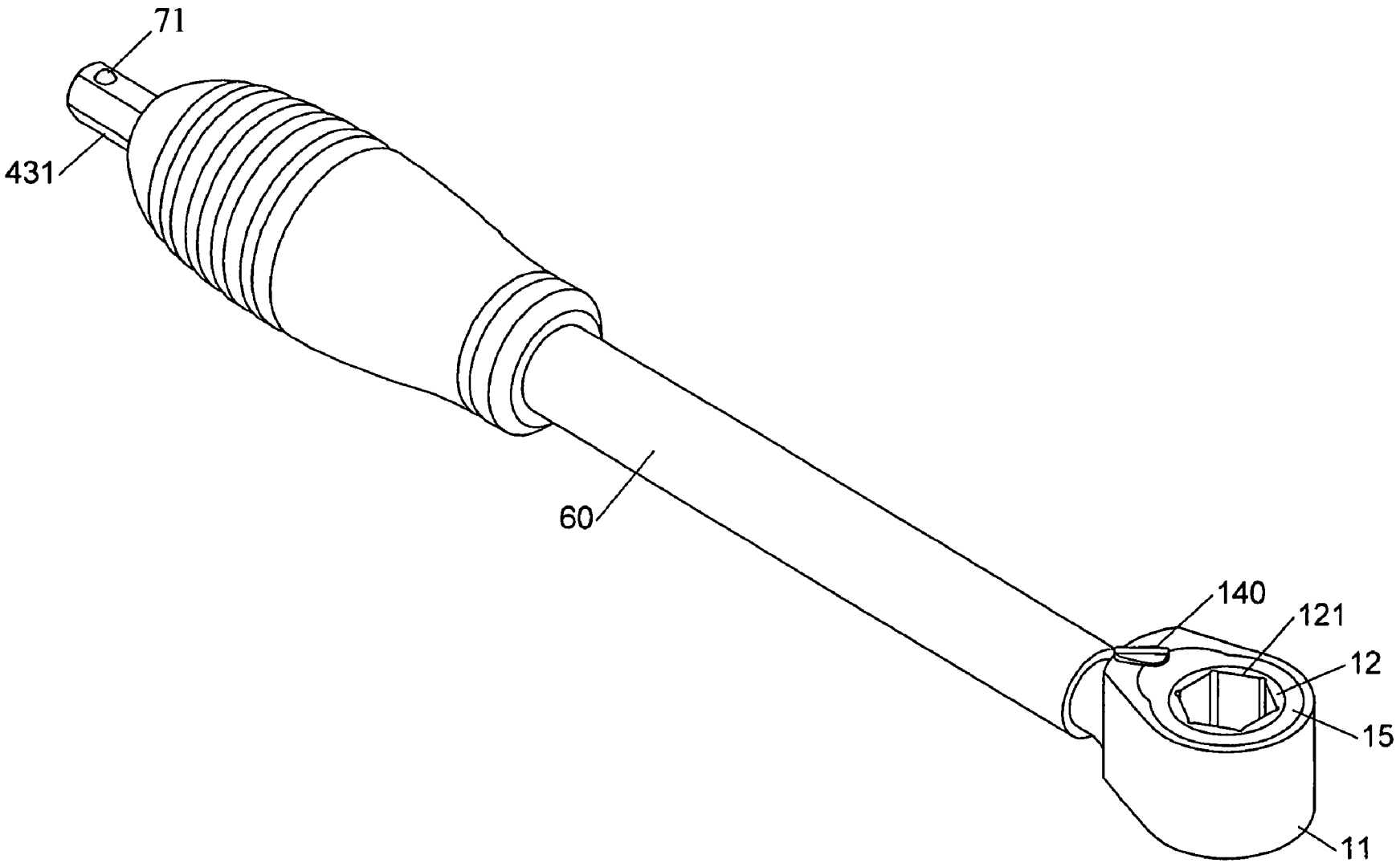
FIG. 3 is a block diagram of FIG. 1 being assembled.

FIGS. 2 and 3 illustrate the inner sectional view of the present invention. The second tooth member 31 of the second gearwheel 30 engages the first tooth 21 of the first gearwheel 20. The second joint member 22 of the first gearwheel 20 is connected and fixed to the first joint member 123 of the rotating member 12. When the user applies a force on the rear end of the gripping member 60 to turn the rear coupling member 431, the driving force through the front coupling member 421 of the front connector 42 will rotate the second gearwheel 30. The second tooth member 31 of the second gearwheel 30 and the first tooth 21 will jointly rotate the first gearwheel 20. Then, the first gearwheel 20 will drive the rotating member 12 and the coupling member 121.

Figure 4:
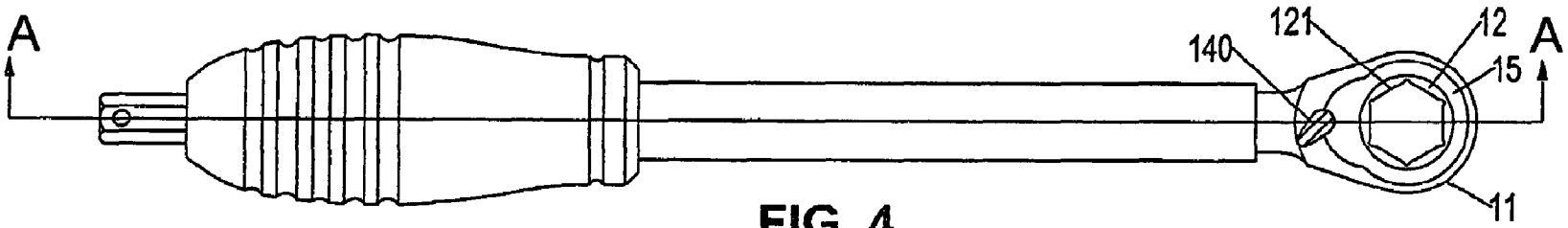
FIG. 4 is a top view of FIG. 1 being assembled.
Figure 5:
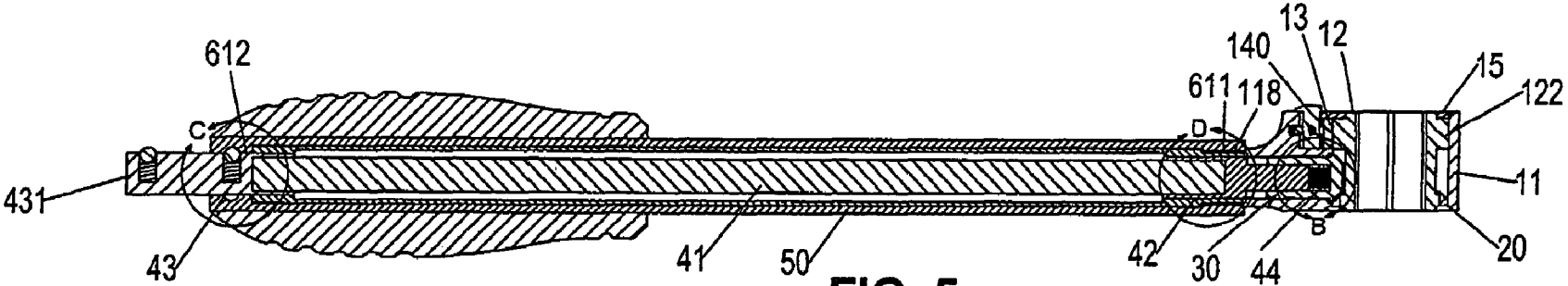
FIG. 5 is a cross sectional view, taken along line A-A in FIG. 4.
Figure 6:
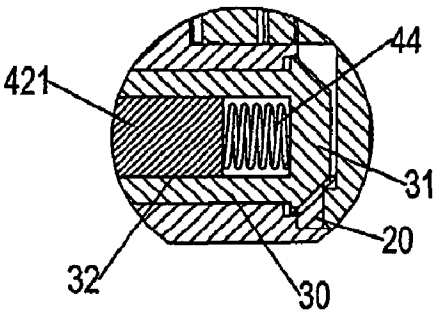
FIG. 6 is an enlarged cross sectional view of the circle B-B in FIG. 5.
Figure 8:
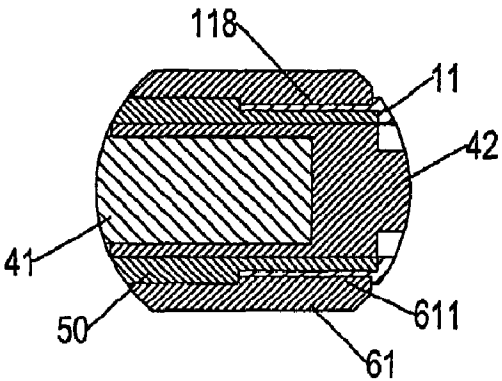
FIG. 8 is an enlarged cross sectional view of the circle D-D in FIG. 5.
Figure 7:
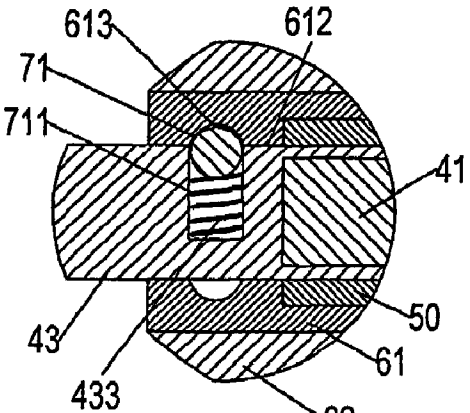
FIG. 7 is an enlarged cross sectional view of the circle C-C in FIG. 5.
Figure 9:
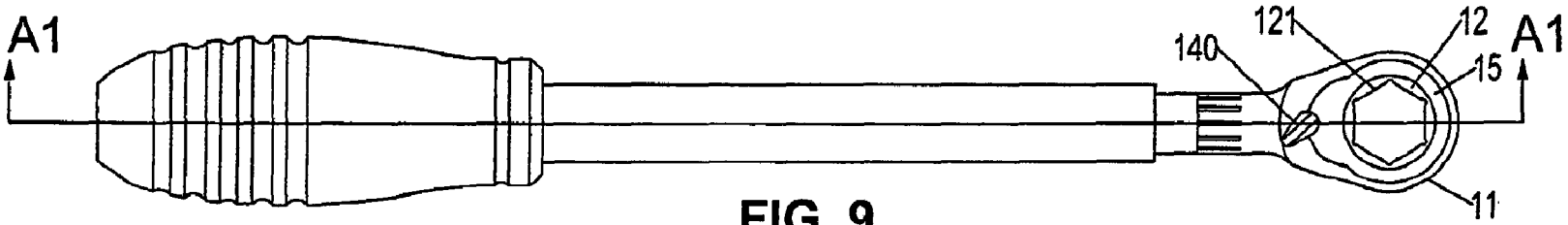
FIG. 9 is an action view corresponding to FIG. 4.
Figure 10:
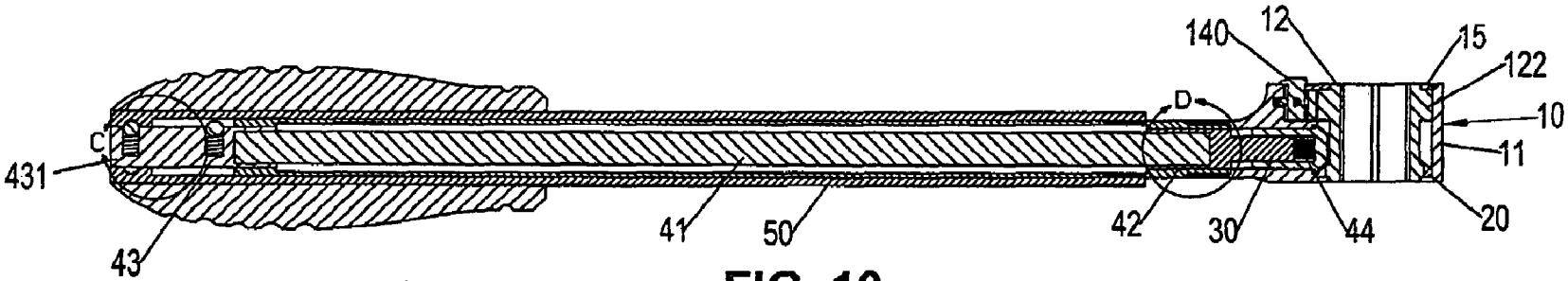
FIG. 10 is a cross sectional view, taken along line A1-A1 in FIG. 9.
Figure 12:
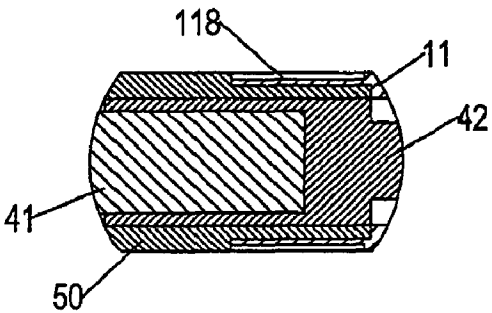
FIG. 12 is an enlarged cross sectional view of the circle D-D in FIG. 10.
Figure 11:
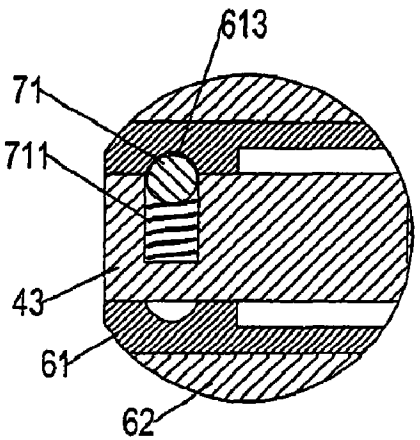
FIG. 11 is an enlarged cross sectional view of the circle C-C in FIG. 10.

As FIGS. 4~6 shown, the first resilient member 44 is accommodated in the coupling portion 32 of the second gearwheel 30, and shores up the front coupling member 421 of the front connector 42. The second tooth member 31 of the second gearwheel 30 is pushed by the bouncing force of the first resilient member 44, and closely engages with the first tooth 21. As FIGS. 5~8 shown, when the third joint member 611 of the straight bar member 61 is connected to the connecting grip 118 of the body 11, the rear coupling member 431 and the fourth joint member 612 are in uncoupled status. The rear coupling member 431 of the rear connector 43 is exposed outside the rear end of the gripping member 60. The second ball member 71 in the first sunk hole 433 lodges in the straight bar member 61 because of the bouncing force of the second resilient member 711. The user can apply force to turn the rear coupling member 431 of the rear connector 43. The force through the woundable bar member 41, the front connector 42, the second gearwheel 30 and the first gearwheel 20 drives the rotating member 12 to rotate. When the rear coupling member 431 is turned, the straight bar member 61 and the gripping unit 62 do not rotate. When the third joint member 611 of the straight bar member 61 is fixedly connected to the connecting grip 118 of the body 11, the straight bar member 61 and the body 11 form one complete unit. The user may apply force to turn the straight bar member 61 so as to turn the whole driving head 10, and the pawl 13 drives the rotating member 12 to make unidirectional rotation. Thus, the woundable and unidirectional driving torque wrench can be operated in normal way.

As FIGS. 9~12 shown, when the connecting grip 118 is separated from the third joint member 611 of the straight connecting bar member 61, the rear coupling member 431 and the fourth joint member 612 are in a connecting status. The rear coupling member 431 of the rear connector 43 is hidden inside the gripping member 60. The second ball member 71 of the second sunk hole 434 of the rear connector 43 lodges in the positioning groove 613 of the straight bar member 61 because of the bouncing force of the second resilient member 711. The user may apply force to drive the gripping unit 62 and the straight bar member 61 so that the rear connector 43 can make relative rotation to the driving head 10. The force through the woundable bar member 41, the front connector 42, the second gearwheel 30 and the first gearwheel 20 drives the rotating member 12 to make a relative rotation to the body 11.

Figure 13:
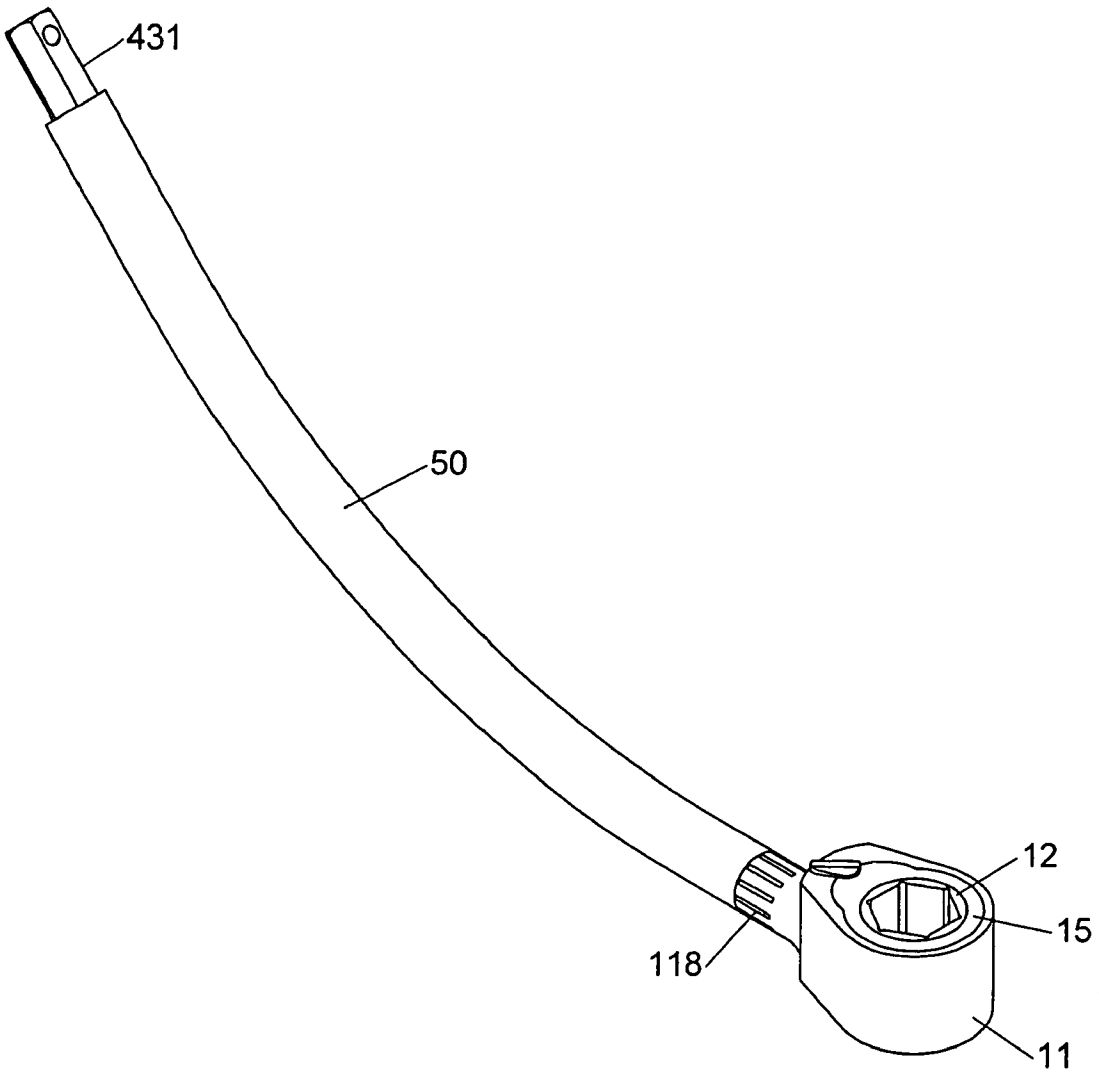
FIG. 13 is a schematic view illustrating the application of the present invention without gripping member.

Please also see FIGS. 1 and 13. When the user needs to work in a narrower or winding space, the gripping unit 62 of the gripping member 60 and the straight bar member 61 can be removed from the driving head 10. Then, the user can bend the resilient tube 50 and the woundable member 40 into a required angle, place the body 11 in the work space, and apply force to turn the rear coupling member 431 exposed behind the resilient tube 50. Its force through the woundable member 40, the second gearwheel 30 and the first gearwheel 20 drives the rotating member 12 to make a relative rotation to the body 11. After completing the work, eliminate the force applied to the resilient tube 50, the resilient tube 50 and the woundable member 40 can automatically restore to a straight shape.

Figure 14:
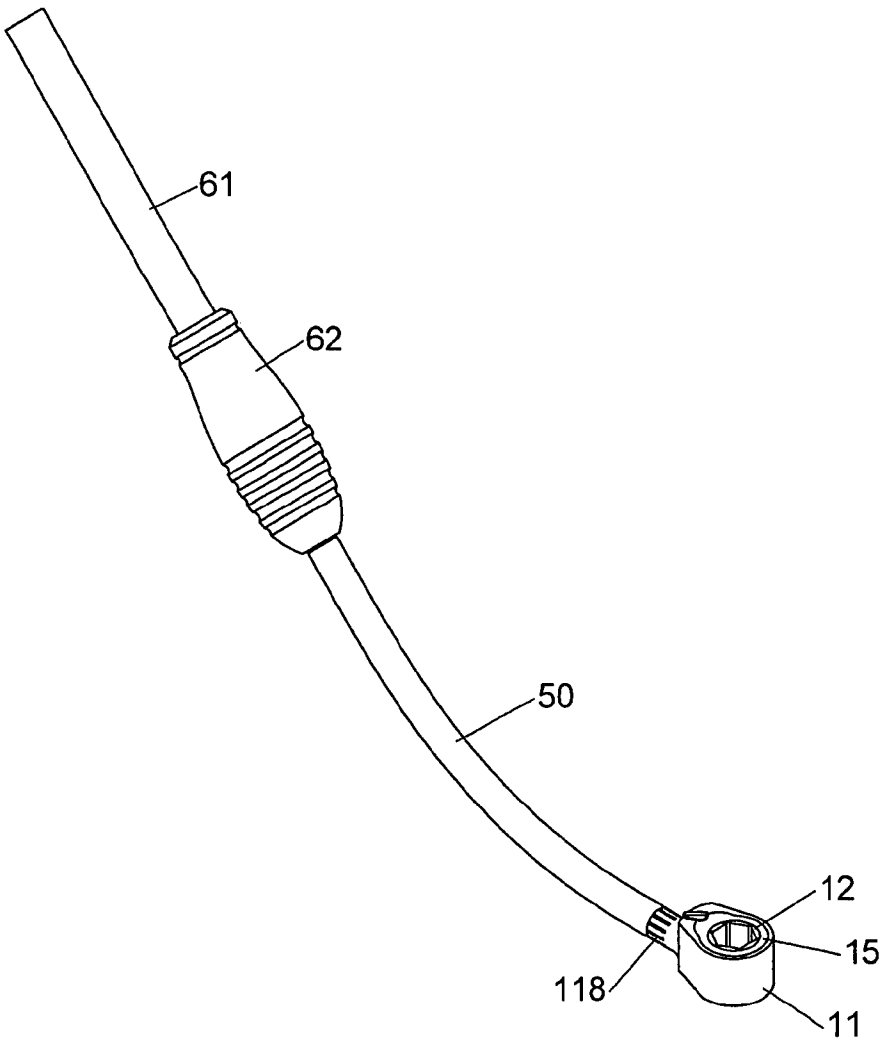
FIG. 14 is a schematic view illustrating the griping member of the present invention in reverse connection with woundable member.

As FIGS. 1 and 14 shown, the gripping member 60 can connect the reverse end of the woundable member 40. In word words, the fourth joint member 612 of the straight bar member 61 couples with the rear coupling member 431. When a force is applied to turn the gripping member 60, its driving force through the woundable member 40 turns the rotating member 12.

As stated above, the present invention has several operation methods to meet the needs of a variety of work environment. This is the biggest advantage of the present invention.

Figure 15:
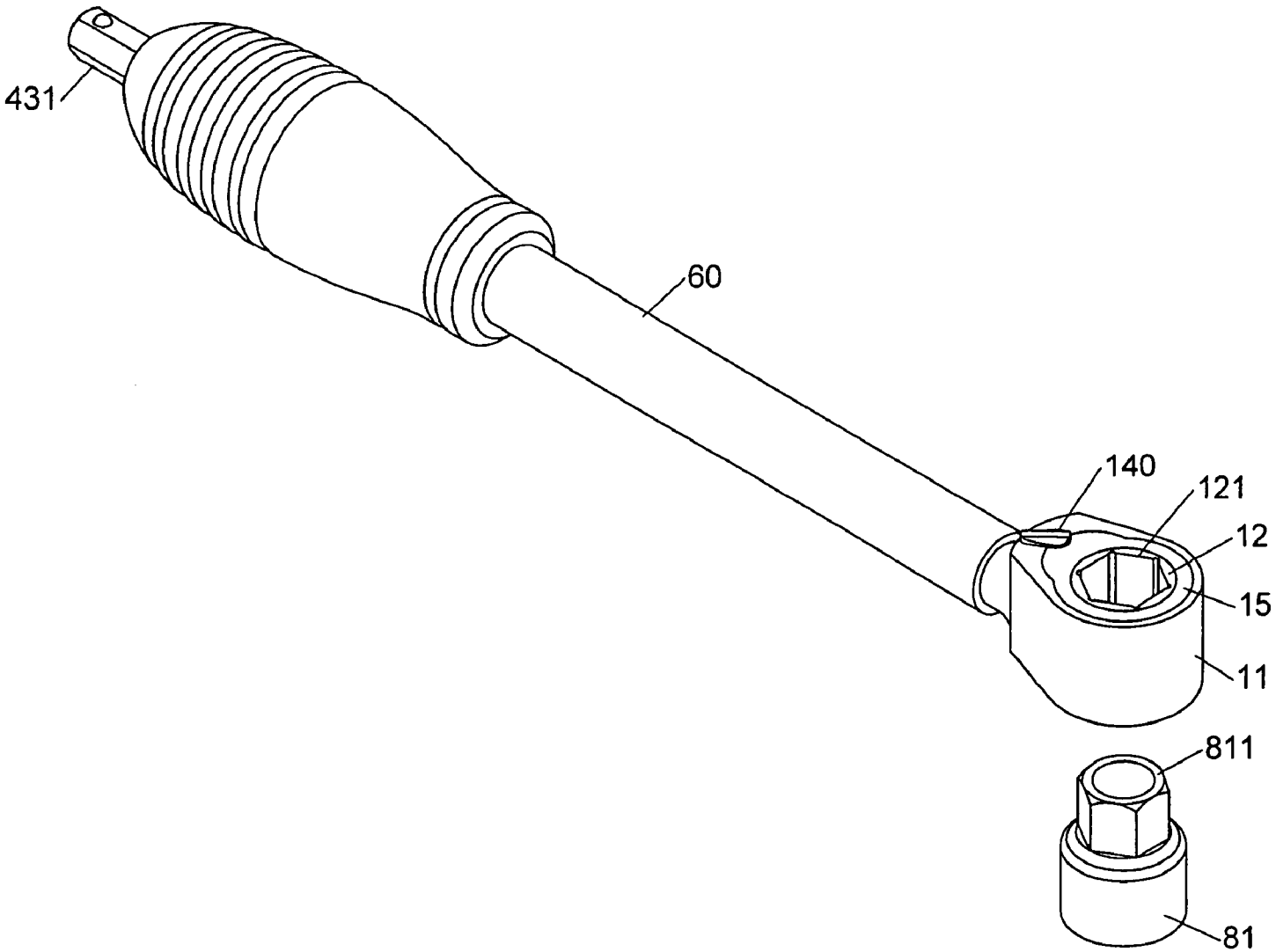
FIG. 15 is a schematic view of present invention with socket.

As FIG. 15 shown, the male coupling member 121 of the rotating member 12 of the present invention can be coupled with a polygonal column 811 at the top end of the socket 81. Furthermore, the control member 140 can control the rotating member 12 to make unidirectional driving.

Figure 16:
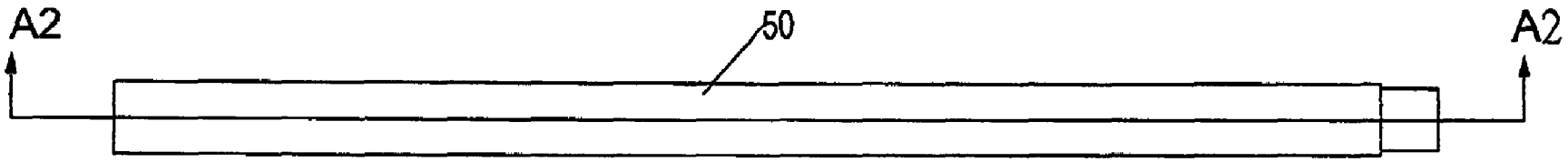
FIG. 16 is a top view of the flexible tube whose inside is with flexible member.
Figure 17:
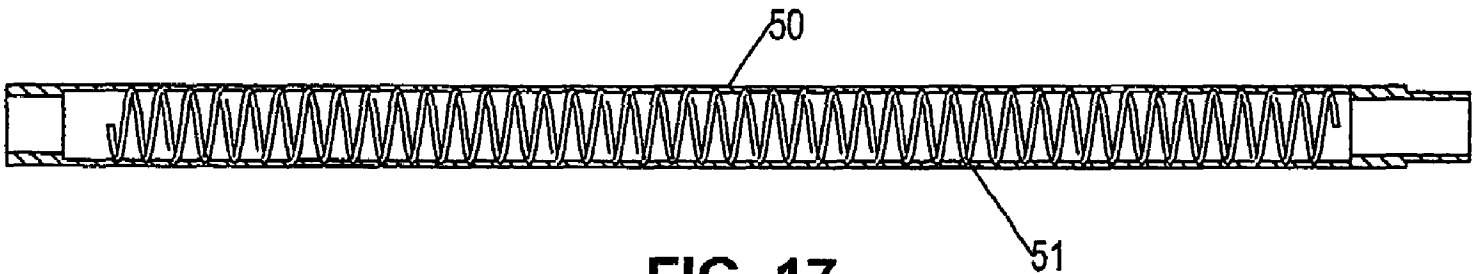
FIG. 17 is a cross sectional view, taken along line A2-A2 in FIG. 16.
Figure 18:
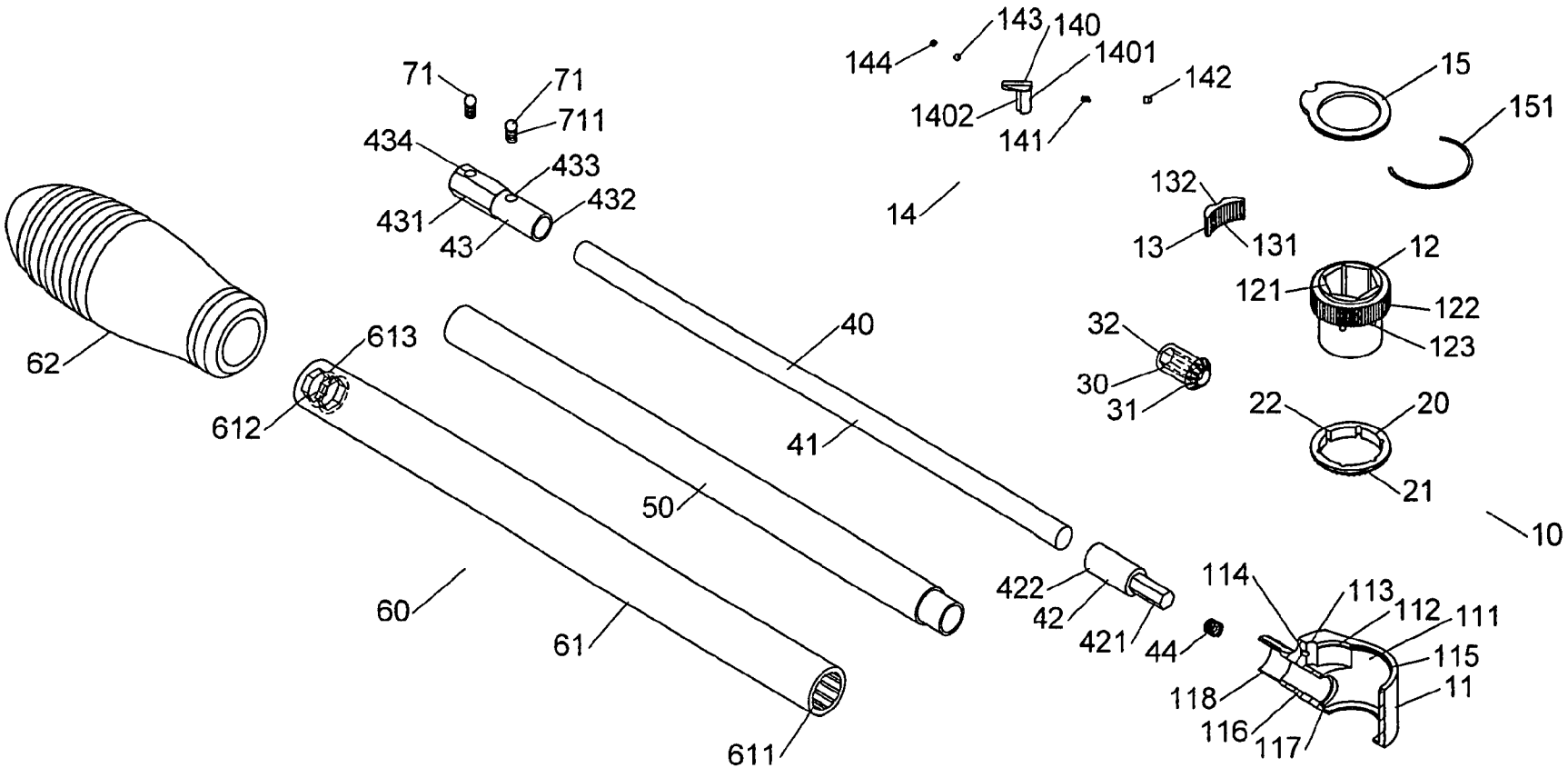
FIG. 18 is a 3D exploded drawing of the second exemplary embodiment of the present invention.

As FIGS. 16 and 17 shown, the inner space of the resilient tube 50 can be added one resilient member 51 which assists the resilient tube 50 to restore to straight shape.

Figure 19:
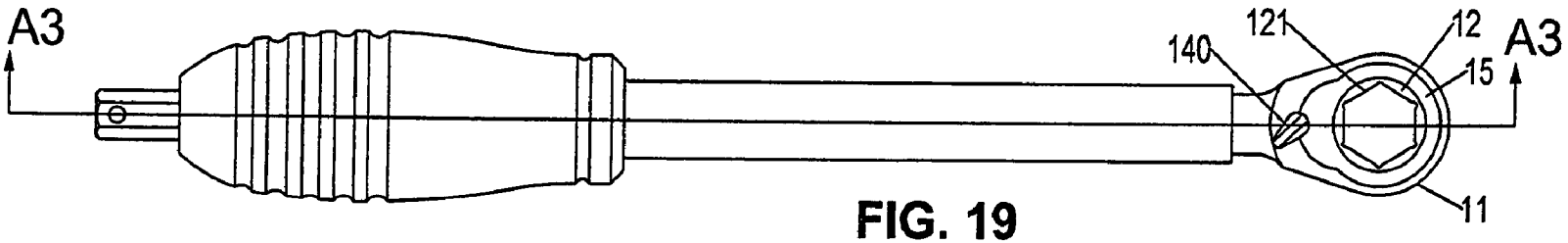
FIG. 19 is a top view of FIG. 18 being assembled.
Figure 20:
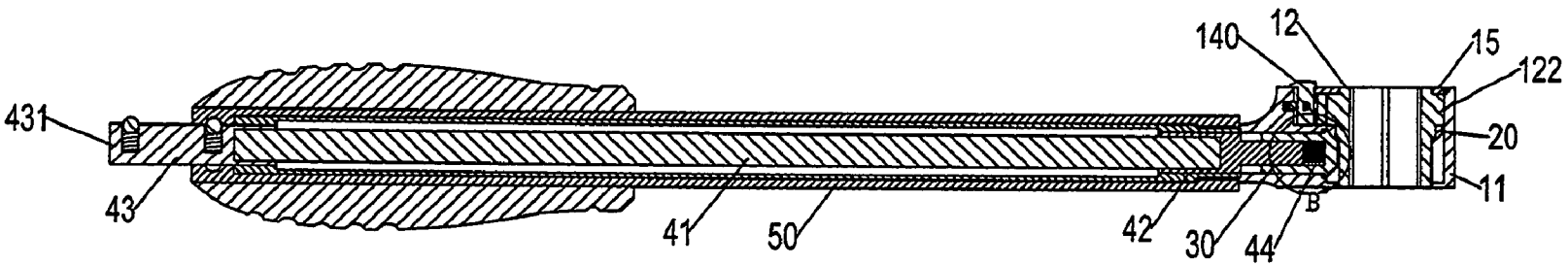
FIG. 20 is a cross sectional view, taken along line A3-A3 of FIG. 19.
Figure 21:
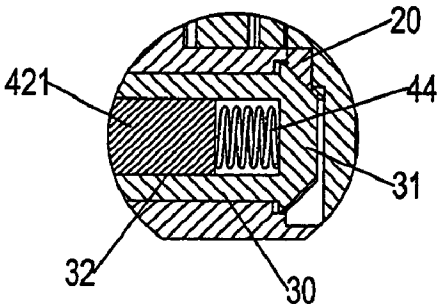
FIG. 21 is an enlarged cross sectional view of the circle B-B in FIG. 20.

As FIGS. 19~21 shown, the first joint member 123 of the rotating member 12 is closely beneath the meshing teeth 122. Please compare the status of the position of FIG. 1. The teeth of the first tooth 21 of the first gearwheel 20 are downward. The first gearwheel 20 is fixed to the first joint member 123, and closely beneath the meshing teeth 122. The first resilient member 44 is accommodated in the female coupling member 32 of the second gearwheel 30. Each of its two ends shores up the front coupling member 421 of the front connector 42 and the second gearwheel 30 respectively. Thus, the second tooth member 31 of the second gearwheel 30 closely engages the first tooth 21 of the first gearwheel 20 because of the bouncing force of the first resilient member 44.

Figure 22:
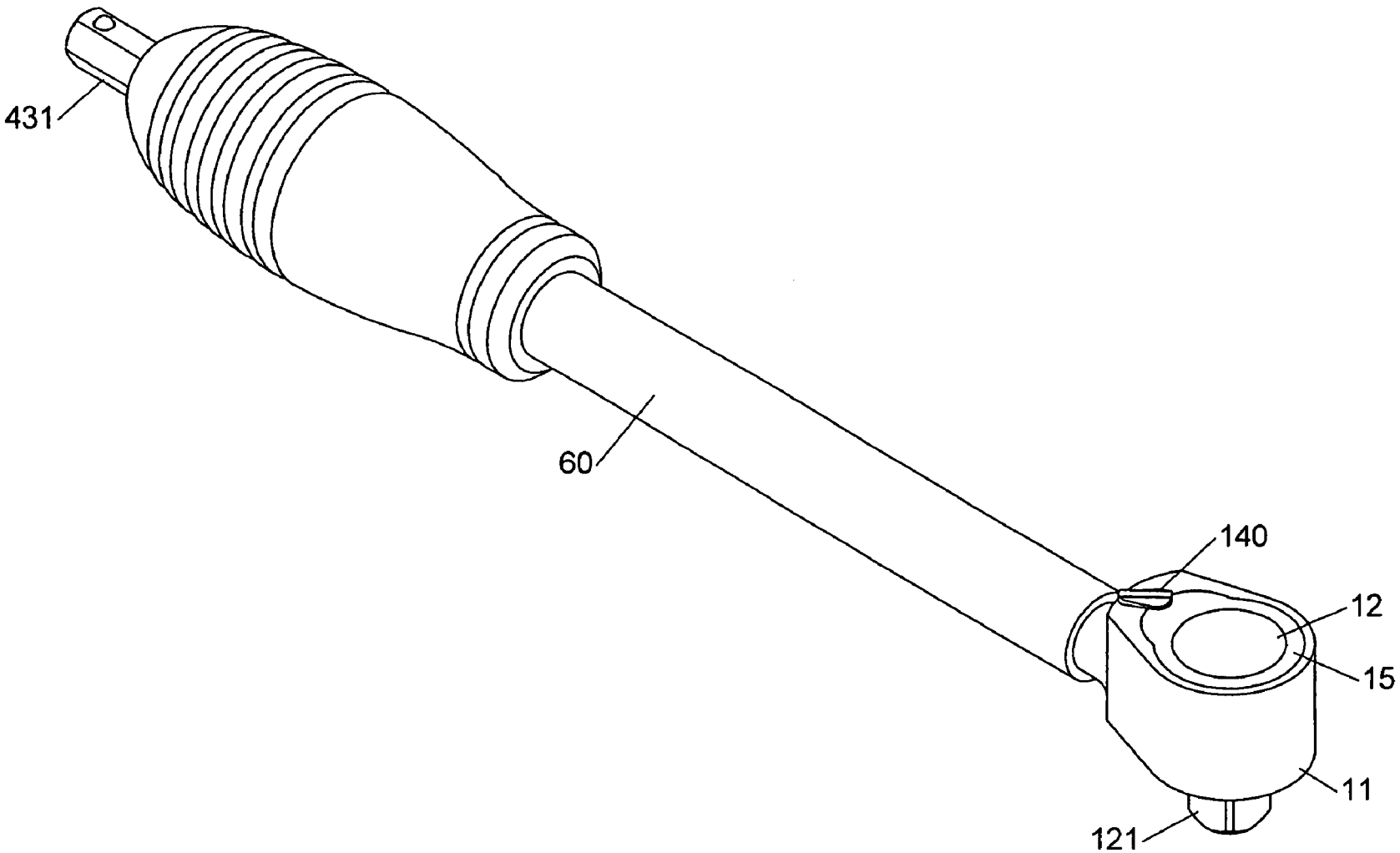
FIG. 22 is another exemplary schematic view of the coupling area of the turning member of the present invention.

As FIG. 22 shown, the male coupling member of the rotating member 12 can be a raised polygonal column. The male coupling member 121 can be coupled with a socket (not shown in the figure).

Figure 23:
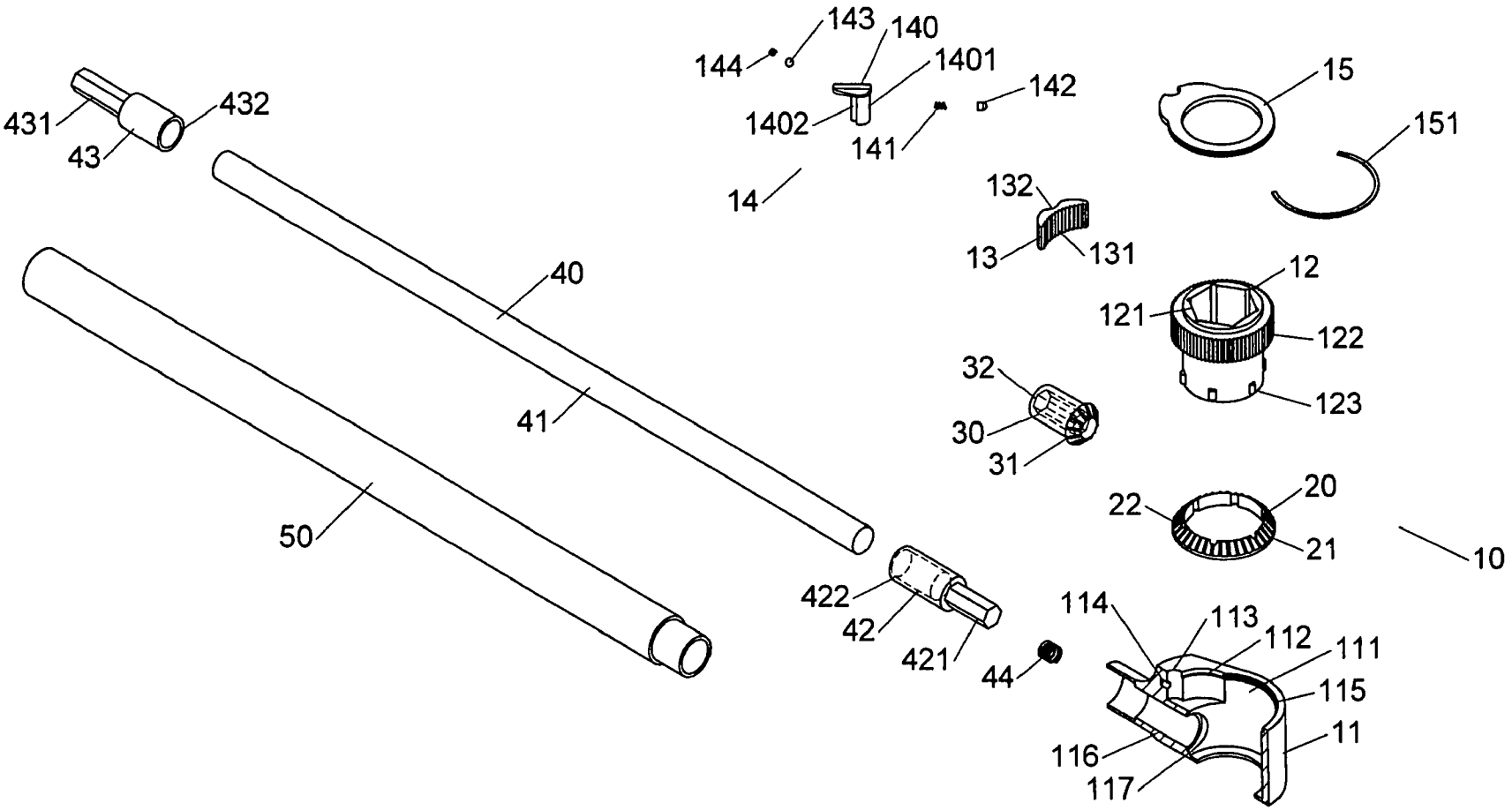
FIG. 23 is an exemplary schematic view of the present invention without griping member.
Figure 24:
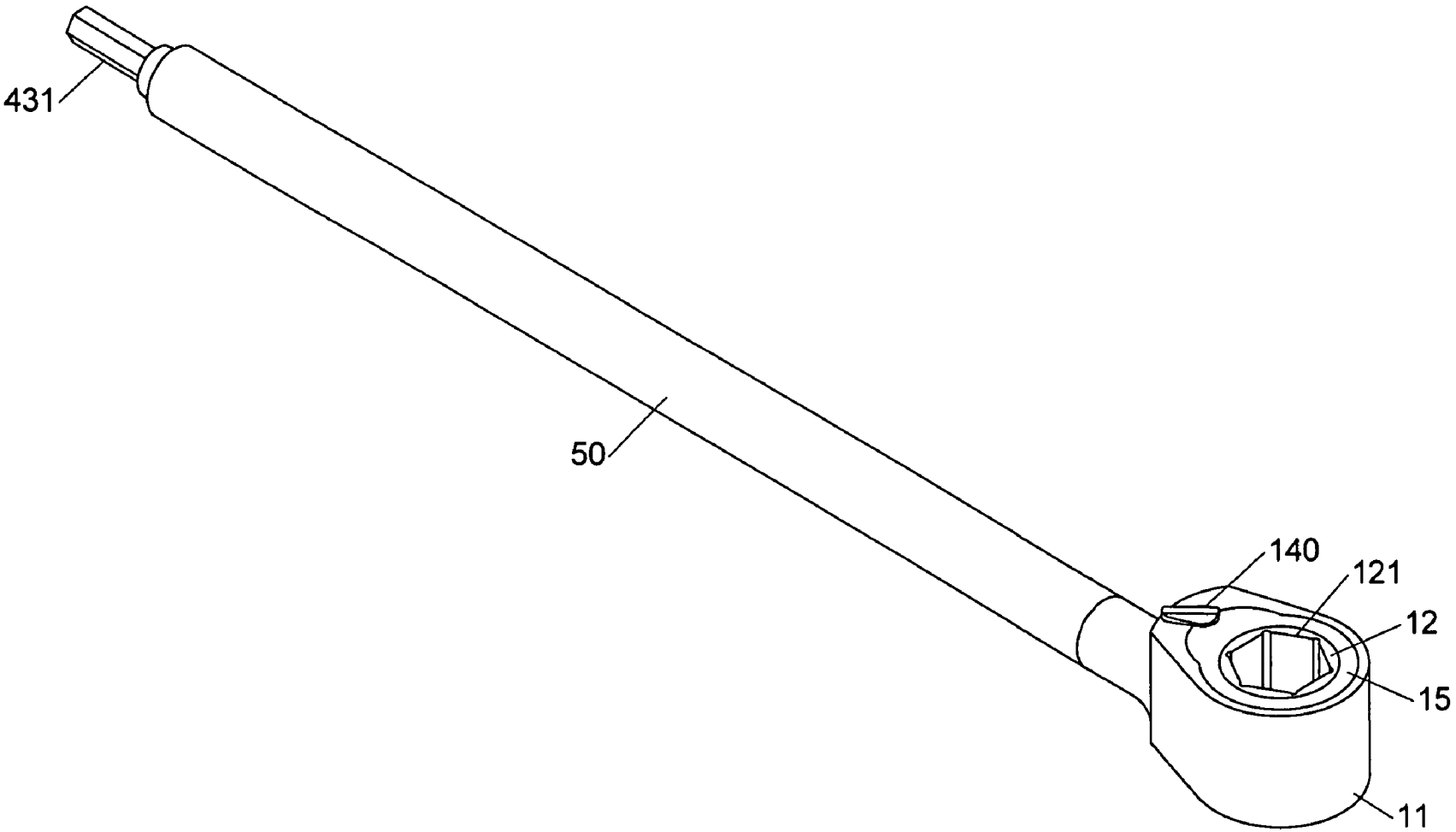
FIG. 24 is a block diagram of FIG. 23.
Figure 25:
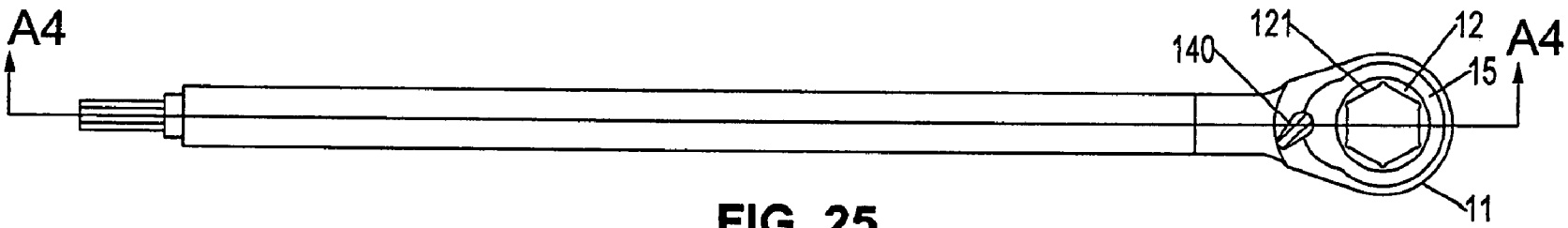
FIG. 25 is a top view of FIG. 23 being assembled.
Figure 26:
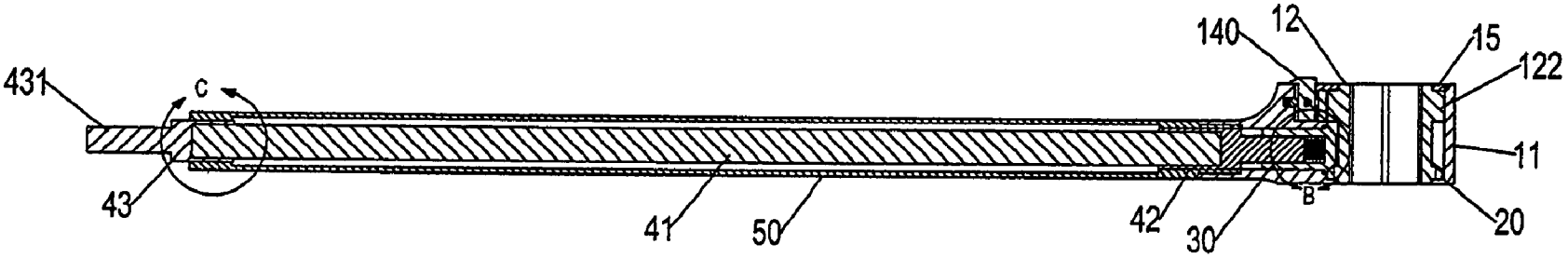
FIG. 26 is a cross sectional view, taken along line A4-A4 of FIG. 25.
Figure 27:
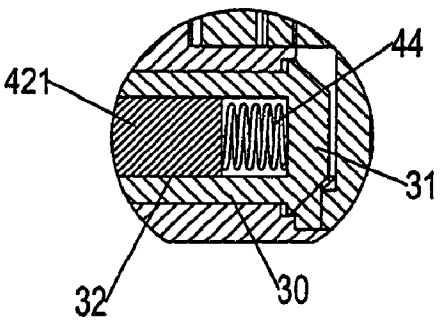
FIG. 27 is an enlarged cross sectional view of the circle B-B in FIG. 26.
Figure 28:
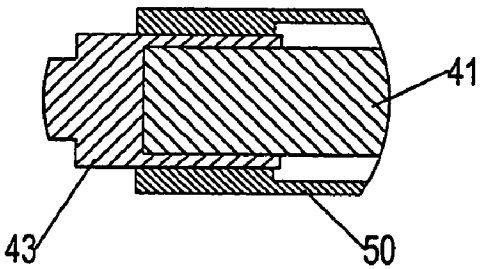
FIG. 28 is an enlarged cross sectional view of the circle C-C in FIG. 26.

Comparing FIGS. 23 and 1, the outer surface of the rear connector 43 neither has a first sunk hole 433 and a second sunk hole 434 as FIG. 1 shown, nor has one gripping member 60, two second ball members 71 and two second resilient members 711 as FIG. 1 shown. FIGS. 24~28 illustrate the structure status after assembling.

Another exemplary embodiment of the present invention is that the rotating member 12 and the first gearwheel 20 can be of one piece unit. In other words, there is one-piece-formed first tooth 21 at the bottom end of the rotating member 12.

A further exemplary embodiment of the present invention is that the woundable bar member 41, the front connector 42 and the rear connector 43 can be of one piece unit. In other words, the middle section of the woundable member 40 is flexible, and its two ends form one front coupling member 421 and one rear male coupling member respectively.

The biggest advantages of the present invention are as followings:

1. The structure of the grip of the wrench primarily comprises one woundable member 40 and one resilient tube 50. Because the woundable member 40 and the resilient tube 50 are resilient, when the user needs to work in a narrower or a winding space, he can adjust the bending angle of the wrench to fit the work space for working convenience, and further solve the problem of the space limitation when a conventional wrench is used.

2. The resilient tube 50 can restore to straight shape automatically when there is no external force to bend the resilient tube 50. The resilient tube 50 can restrain the woundable member 40 to deform.
3. When the fourth male coupling unit 611 of the gripping member 60 couples with the third joint member 118 of the body 11, the user can directly apply force on the rear male coupling member 431 of the rear connector 43 so as to drive the rotating member 12 to make rotation.
4. When the fourth male coupling unit 611 of the gripping member 60 is separated from the third joint member 118 of the body 11, the fourth joint member 612 of the straight bar member 61 will be fixedly coupled with the rear male coupling member 431 of the rear connector 43. The user can apply force to the gripping member 60 to drive the rotating member 12 to make rotation.

While we have shown and described the embodiment in accordance with the present invention, it should be clear to those skilled in the art that further embodiments may be made without departing from the scope of the present invention.

What is claimed is:

1. A woundable ratchet wrench which comprises:

a driving head including a body, a rotating member, a pawl and a control structure, said body member having a first accommodation chamber with a vertical facing opening, said first accommodation chamber communicating with a second accommodation chamber, the central axial line of said rotating member being vertical extension, said rotating member rotatably mounted in the first accommodation chamber, a connecting grip horizontally stretching out from one side of said body member, a small pivot hole penetrating through said connecting grip, one end of said small pivot hole communicating with said first accommodation chamber, said rotating member having a coupling member to connect one workpiece, the outer surface of the top of the rotating member surrounded with a plurality of meshing tooth, said pawl movably and rotatably mounted in said second accommodation chamber, said pawl's front end facing said rotating member having one retaining tooth for engaging said meshing tooth, the relatively contacted position of said pawl to said rotating member being moved by means of said control structure so as to control said rotating member to make unidirectional clockwise or counterclockwise rotation;

a first gearwheel whose outer surface surrounded with a plurality of first tooth, said first gearwheel and said rotating member being able to make a coaxial and synchronal rotation, said first gearwheel being inside said first accommodation chamber;

a second gearwheel rotatably mounted in said small pivot hole of said body, said second gearwheel which faces one front end of said first gearwheel being surrounded with a plurality of second tooth member to engage the plurality of first tooth, a female coupling member being provided at the rear end of said second gearwheel;

a woundable member with a front end connected to said second gearwheel, a rear end of said woundable member being able to be driven by an external force;

a resilient tube whose interior being for accommodating said woundable member, a front end of said resilient tube being fixedly connected to said body, said rear end of said woundable member exposing outside a rear end of said resilient tube, said resilient tube being able to restore to a straight tube shape when said resilient tube is not bent by external force; and a gripping member, said gripping member includes a rigid straight bar member which accommodates said resilient tube, a front end of said straight bar member has a third joint member which couples with said connecting grip of said body, a rear end of said straight bar member has a fourth joint member which couples with a rear coupling member at the rear end of said woundable member, said fourth joint member is in a separating status from said rear coupling member when said third joint member of said straight bar member couples with said connecting grip, and said fourth joint member couples with said rear coupling member when said third joint member is separated from said connecting grip.

2. The wrench as claimed in claim 1, wherein said rear coupling member of said woundable member is a raised hexagonal column, and said fourth joint member of said straight bar member is a hexagonal chamber to fit said hexagonal column.

3. The wrench as claimed in claim 1, wherein said rear coupling member of said woundable member is provided on a rear connector fixed on the rear end of the woundable member, the outer surface of said rear connector has one first sunk hole and one second sunk hole, the inner surface of the fourth joint member of said straight bar member has an annual positioning groove, said first sunk hole and second sunk hole accommodate one first ball member and one second resilient member respectively, and one of said ball members lodges in said positioning groove of said straight bar member.

4. The wrench as claimed in claim 1, wherein said gripping member further comprises one gripping unit which couples with said straight bar member for user's gripping.

5. A woundable ratchet wrench which comprises:

a driving head including a body, a rotating member, a pawl and a control structure, said body member having a first accommodation chamber with a vertical facing opening, said first accommodation chamber communicating with a second accommodation chamber, the central axial line of said rotating member being vertical extension, said rotating member rotatably mounted in the first accommodation chamber, a connecting grip horizontally stretching out from one side of said body member, a small pivot hole penetrating through said connecting grip, one end of said small pivot hole communicating with said first accommodation chamber, said rotating member having a coupling member to connect one workpiece, the outer surface of the top of the rotating member surrounded with a plurality of meshing tooth, said pawl movably and rotatably mounted in said second accommodation chamber, said pawl's front end facing said rotating member having one retaining tooth for engaging said meshing tooth, the relatively contacted position of said pawl to said rotating member being moved by means of said control structure so as to control said rotating member to make unidirectional clockwise or counterclockwise rotation;

a first gearwheel whose outer surface surrounded with a plurality of first tooth, said first gearwheel and said rotating member being able to make a coaxial and synchronal rotation, said first gearwheel being inside said first accommodation chamber;

a second gearwheel rotatably mounted in said small pivot hole of said body, said second gearwheel which faces one front end of said first gearwheel being surrounded with a plurality of second tooth member to engage the plurality of first tooth, a female coupling member being provided at the rear end of said second gearwheel;

a woundable member with a front end connected to said second gearwheel, a rear end of said woundable member being able to be driven by an external force; and a resilient tube whose interior being for accommodating said woundable member, a front end of said resilient tube being fixedly connected to said body, said rear end of said woundable member exposing outside a rear end of said resilient tube, said resilient tube being able to restore to a straight tube shape when said resilient tube is not bent by external force;

wherein said woundable member comprises a woundable bar member, a front connector and a rear connector, said woundable bar member is a long extending bar, said woundable bar member can be bended and wound at will by external force, a front coupling member is provided at the front end of said front connector, said front coupling member couples with a coupling portion of said second gearwheel, a rear coupling member is at the rear end of said front connector, said rear coupling member couples with the front end of said woundable bar, a rear coupling member which can be driven by external force is at the rear end of said rear connector, a front coupling member is at the front end of said rear connector, and said front coupling member of the rear connector is fixed to the rear end of said woundable bar.

6. The wrench as claimed in claim 5, wherein said coupling portion of said second gearwheel is a hex chamber, and said front coupling member of said front connector is a hex column to fit said hex chamber.

7. The wrench as claimed in claim 5, wherein said coupling member of said rear connector is a raised hex column.

8. The wrench as claimed in claim 5, wherein said woundable bar of said woundable member, said front connector and said rear connector are of one-piece-unit, the middle section of said woundable member is a soft body to form a woundable bar, and its front end forms said front connector while its rear end forms said rear connector.

9. The wrench as claimed in claim 5, wherein said coupling portion of said second gearwheel is a coupling hole, a first resilient member is accommodated in said coupling hole, the two ends of said first resilient member shoring up said second gearwheel and said woundable member.

10. A woundable ratchet wrench which comprises:

a driving head including a body, a rotating member, a pawl and a control structure, said body member having a first accommodation chamber with a vertical facing opening, said first accommodation chamber communicating with a second accommodation chamber, the central axial line of said rotating member being vertical extension, said rotating member rotatably mounted in the first accommodation chamber, a connecting grip horizontally stretching out from one side of said body member, a small pivot hole penetrating through said connecting grip, one end of said small pivot hole communicating with said first accommodation chamber, said rotating member having a coupling member to connect one workpiece, the outer surface of the top of the rotating member surrounded with a plurality of meshing tooth, said pawl movably and rotatably mounted in said second accommodation chamber, said pawl's front end facing said rotating member having one retaining tooth for engaging said meshing tooth, the relatively contacted position of said pawl to said rotating member being moved by means of said control structure so as to control said rotating member to make unidirectional clockwise or counterclockwise rotation;

a first gearwheel whose outer surface surrounded with a plurality of first tooth, said first gearwheel and said rotating member being able to make a coaxial and synchronal rotation, said first gearwheel being inside said first accommodation chamber;

a second gearwheel rotatably mounted in said small pivot hole of said body, said second gearwheel which faces one front end of said first gearwheel being surrounded with a plurality of second tooth member to engage the plurality of first tooth, a female coupling member being provided at the rear end of said second gearwheel;

a woundable member with a front end connected to said second gearwheel, a rear end of said woundable member being able to be driven by an external force;

a resilient tube whose interior being for accommodating said woundable member, a front end of said resilient tube being fixedly connected to said body, said rear end of said woundable member exposing outside a rear end of said resilient tube, said resilient tube being able to restore to a straight tube shape when said resilient tube is not bent by external force; and a gripping member, said gripping member includes a rigid straight bar member which accommodates said resilient tube, a front end of said straight bar member has a third joint member which couples with said connecting grip of said body, a rear end of said straight bar member has a fourth joint member which couples with a rear coupling member at the rear end of said woundable member, said fourth joint member is in a separating status from said rear coupling member when said third joint member of said straight bar member couples with said connecting grip, and said fourth joint member couples with said rear coupling unit when said third joint member is separated from said connecting grip;

wherein said rear coupling member of said woundable member is a raised hexagonal column, and said fourth joint member of said straight bar member is a hexagonal chamber to fit said hexagonal column; said rear coupling member of said woundable member is provided on a rear connector fixed on the rear end of the woundable member, the outer surface of said rear connector has one first sunk hole and one second sunk hole, the inner surface of the fourth joint member of said straight bar member has an annual positioning groove, said first sunk hole and second sunk hole respectively accommodate a first ball member and a second resilient member respectively, and one of said ball members lodges in said positioning groove of said straight bar member; said gripping member further comprises a gripping unit which couples with said straight bar member for user's gripping;

wherein said woundable member comprises a woundable bar member, a front connector and a rear connector, said woundable bar member is a long extending bar, said woundable bar member can be bended and wound at will by external force, a front coupling member is provided at the front end of said front connector, said front coupling member couples with a coupling portion of said second gearwheel, a rear coupling member is at the rear end of said front connector, said rear coupling member couples with the front end of said woundable bar, a rear coupling member which can be driven by external force is at the rear end of said rear connector, a front coupling member is at the front end of said rear connector, and said front coupling member of the rear connector is fixed to the rear end of said woundable bar; said coupling portion of said second gearwheel is a hex chamber, and said front coupling member of said front connector is a hex column to fit said hex chamber; said coupling member of said rear connector is a raised hex column; said woundable bar of said woundable member, said front connector and said rear connector are of one-piece-unit, the middle section of said woundable member is a soft body to form a woundable bar, and its front end forms said front connector while its rear end forms said rear connector; said coupling portion of said second gearwheel is a coupling hole, a first resilient member is accommodated in said coupling hole, the two ends of said first resilient member shoring up said second gearwheel and said woundable member.

* * * * *